US006113712A

United States Patent [19]

Ciaramitaro et al.

[11] Patent Number: 6,113,712

[45] Date of Patent: Sep. 5, 2000

[54] ADN STABILIZERS

[75] Inventors: David A. Ciaramitaro; Russell Reed, both of Ridgecrest, Calif.

[73] Assignee: The United States of America as represented by the Secretary of the Navy, Washington, D.C.

[21] Appl. No.: 09/226,616

[22] Filed: Dec. 22, 1998

[51] Int. Cl.[7] ..... C06B 45/10; C06B 25/00

[52] U.S. Cl. ..... 149/19.6; 149/19.1; 149/88

[58] Field of Search ..... 149/19.6, 19.1, 149/88

[56] References Cited

U.S. PATENT DOCUMENTS 5,659,080 8/1997 Suzuki et al. ..... 564/109
5,703,323 12/1997 Rothgery et al. ..... 149/88
5,714,714 2/1998 Stern et al. ..... 149/109.6
5,741,998 4/1998 Hinshaw et al. ..... 149/19.6

OTHER PUBLICATIONS

M. L Chan and A. Turner. "ADN Propellant Technology," in the *Proceedings of the 1995 JANNAF Propulsion Meeting*, Dec. 4–8, 1995, Tampa, Florida. CPIA Publication 630.

*Primary Examiner*—Michael J. Carone
*Assistant Examiner*—Aileen J. Baker
*Attorney, Agent, or Firm*—Gregory M. Bokar; David S. Kalmbaugh

[57] ABSTRACT

ADN stabilizers of aromatic nitrogen-containing heterocyclic organic compounds, such as pyridines, pyrimidines, pyrazines, and triazines substituted with amino, hydroxy or other activating groups. The stabilizers being added to the ADN in an amount of from about 0.001 weight percent to about 5 weight percent of the ADN.

6 Claims, 5 Drawing Sheets

ADN STABILIZERS

FEDERALLY SPONSORED RESEARCH OR DEVELOPMENT

The invention described herein may be manufactured and used by or for the government of the United States of America for governmental purposes without the payment of any royalties thereon or therefor.

BACKGROUND OF THE INVENTION

1. Field of the Invention

This invention relates to stabilizers of ammonium dinitramide (ADN). More particularly, the ADN stabilizers are heterocyclic organic compounds added to ADN for use as an oxidizer for propellents, pyrotechnics, gas generators, explosives and like formulations. Most particularly, the stabilizer is a substituted pyridine, pyrimidine, pyrazine or triazine, and/or derivatives thereof. The stabilizers increase the thermal stability and the shelf or service life of the ammonium dinitramide, and increase the reliability of the formulations incorporating ADN over extended periods of time and/or after exposure to temperature changes.

2. Description of Related Art

Ammonium perchlorate (AP) is well known as an oxidizer for composite solid propellents. However, AP emits hydrogen chloride in the exhaust gas, impeding its use in several types of applications and raising objections to its use because of environmental degradation. One possible alternative to AP is ADN which is higher in performance, but does not produce hydrogen chloride as a decomposition product.

ADN is useful as an oxidizer for highly energetic materials, such as propellents, pyrotechnics, and gas generator formulations for such uses as airbag deployment, solid rocket motors, explosives, and the like. ADN is a compound comprising nitrogen, hydrogen and oxygen that can provide a clean exhaust gas, one composed of invisible, nontoxic gases such as nitrogen, carbon dioxide and water vapor. For this reason, in a tactical military scenario, ADN produces a reduced smoke exhaust compared to AP, allowing better protection from discovery for the launch site, as well as providing a more environmentally benign exhaust. The clean exhaust also results in greater occupational safety for crews in confined launch areas, as well as less missile signature during flight.

ADN, as manufactured, is difficult to formulate since it forms crystals of excessive length, making it process poorly in propellent formulations, raising their viscosity and making them difficult to cast. The cooling of molten droplets to form tiny spheres, or prilling, may be used to manufacture the ADN in a more suitable form for processing, but prilling involves melting the ADN, and then stirring or spraying, which necessitates a stabilizer to retard thermal decomposition. The manufacture of ADN has been disclosed in U.S. Pat. No. 5,659,080 (Suzuki et al.) and U.S. Pat. No. 5,714,714 (Stem et al.), the disclosure of these patents are herein incorporated by reference. However, ADN containing compositions tend to decompose when aged at temperatures above ambient. ADN decomposes into nitrous acid ($HNO_2$), nitric acid ($HNO_2O$), nitrous oxide ($N_2O$), , nitrogen dioxide ($NO_2$), ammonium nitrate ($NH_4NO_3$) and water ($H_2O$). The presence of these decomposition products increases the rate of decomposition of the remaining ADN.

Hexamethylenetetramine (hexamine) has been used to stabilize ADN. Generally, hexamethylenetetramine is added prior to prilling. The amount of hexamethylenetetramine used typically is 0.3 to 0.6 weight percent. Addition of 0.3–0.6% of hexamine to ADN melts kept the gas evolution from thermal decomposition low for as long as 6 hours at 120° C. However, when hexamethylenetetramine has fully reacted with the decomposition products of ADN, it no longer is able to inhibit the decomposition of the ADN. Additional decomposition of the ADN after this point results in a vigorous oxidation of any proximate fuel and binder in a formulation, as well as the partially oxidized hexamine, in the ADN. This causes instability and degraded performance and/or safety characteristics in the formulation, either in storage or use.

Pyridine and pyridone have been described as stabilizers for hydroxylammonium nitrate (HAN) and hydroxylamine in U.S. Pat. No. 5,703,323 (Rothgery et al.). However, Rothgery et al. uses pyridine and pyridone as chelation reagents for iron impurities, which catalyze decomposition of HAN and hydroxyl amine. Rothgery et al. mentions the effect of the decomposition products of the hydroxylammonium nitrate and hydroxylamine on the stability of the remaining material, but does not address the scavenging, absorption or neutralization of these decomposition products.

Stable charge-transfer complexes can be formed with acids by nitrogen-containing heterocyclic compounds. In the past, such oxidizers as hydrazinium diperchlorate have been stabilized by addition of these compounds, which include riboflavin and 7-(2,3-dihydroxypropyl)theophylline. Free-radical scavengers, which can also react with acids and nitrogen oxides have been used as stabilizers for hydroxylammonium perchlorate. These include triallyl-1,3,5-triazine-2,4,6-(1H,2H,5H)-trione and triallyloxy-1,3,5-triazene.

Ideally, stabilizers for oxidizers such as ADN should be effective in the smallest possible quantities. Addition of non-energetic compounds to high-energy compounds reduces the energy available to the formulation. Additionally, the incorporation of organic materials into oxidizers may cause sensitivity problems. There is a need for ADN stabilizers having minimal weight and volume relative to their stabilizing effect on the ADN. These ADN and stabilizer compositions should be useful for increasing storage time and resistance to elevated temperatures, resulting in safer handling and aging characteristics particularly when used in propellant formulations for tactical missiles. The present invention addresses these needs.

SUMMARY OF THE INVENTION

The present invention includes a stabilized ammonium dinitramide composition comprising ammonium dinitramide; and an amount of an aromatic, nitrogen-containing heterocyclic organic compound effective to stabilize the ammonium dinitramide.

The present invention further includes an ammonium dinitramide composition made by the process comprising the steps of mixing ammonium dinitramide with an amount of an aromatic, nitrogen-containing heterocyclic organic compound effective to stabilize the ammonium dinitramide.

Additionally, the present invention includes a process for stabilizing ammonium dinitramide comprising the steps of contacting the ammonium dintramide with an amount of stabilizer effective to hinder degradation of the ammonium dintramide, wherein the stabilizer comprises an aromatic, nitrogen-containing heterocyclic organic compound.

The stabilized ammonium dinitramide composition of the present invention is useful in propellants, pyrotechnics, explosives and gas generator formulations. The stabilizers in the present invention inhibit decomposition of ADN during storage and use.

DETAILED DESCRIPTION OF THE PREFERRED EMBODIMENT

Figure 1:
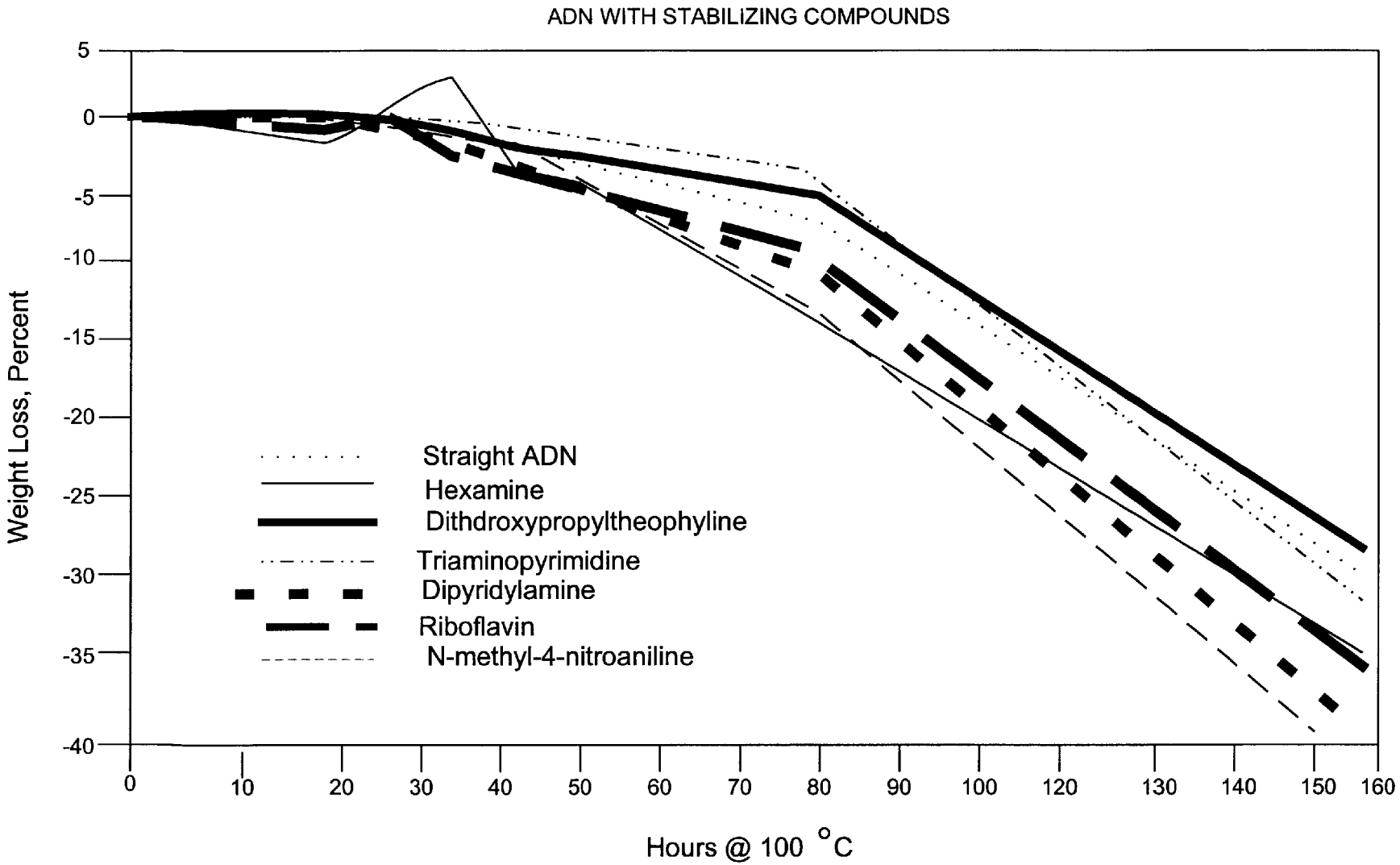
FIG. 1 is a plot of ADN with stabilizing compounds.

The present invention comprises an ammonium dinitramide composition that is stabilized by an aromatic nitrogen-containing heterocyclic organic compound to stabilize the ammonium dinitramide. The present invention further includes an ammonium dinitramide composition made by the process comprising the steps of mixing ammonium dinitramide with an amount of an aromatic nitrogen-containing heterocyclic organic compound effective to stabilize the ammonium dinitramide, and a process for stabilizing ammonium dinitramide comprising the steps of contacting the ammonium dintramide with an amount of stabilizer effective to hinder degradation of the ammonium dintramide, wherein the stabilizer comprises an aromatic nitrogen-containing heterocyclic organic compound. Preferably the stabilized ammonium dinitramide is used as an oxidizer. The stabilized ADN may be used alone or in combination with any other components that together comprise an effective propellant, pyrotechnic, explosive, rocket fuel, gas generator formulation, and other like energetic compositions. These components typically include binders, plasticizers, solid fuels, metals and energetic materials.

The stabilizers in the present invention protect the ADN against unwanted degradation during storage, prior to use as an oxidizer. The stabilizer effectively stabilizes the ADN against thermal and chemical degradation to a degree that permits the processing and use of the oxidizer for a given purpose. This degradation in the absence of stabilizer compounds produces nitrogen oxides, nitrous acid and nitric acid. These degradation products cause increased instability and further degradation of the ADN. When used as an oxidizer in formulations, ADN generally is suspended in a binder component. Generally known binders are liquid polyols that typically are cured with isocyanates to yield elastomeric polyurethanes. Additionally, a metallic component, solid fuel or an energetic material may be present.

ADN decomposes thermally as follows:

$$NH_4^+—N^-—(NO_2)_2 \rightarrow HNO_3+N_2O+NO_2+NH_4NO_3+H_2O \quad (I)$$

The stabilizer comprises an aromatic nitrogen-containing heterocyclic organic compound that captures and neutralizes the decomposition products of the ADN. The stabilizer is selected so as to not react with the binder and/or metallic components or in a manner that would deleteriously affect their function or that of the ADN oxidizer. Preferably, the heterocyclic organic compound is able to form a charged transfer complex with acidic ADN decomposition products. It is more preferably a nitrogen containing compound, and most preferably an aromatic nitrogen-containing ring or a fused combination ring structure. In a preferred embodiment, the heterocyclic organic compound comprises a six-membered ring, having from about 1 to about 3 nitrogen atoms internally located within the ring structure, more preferably from about 1 to about 2 nitrogen atoms, and most preferably about 2 nitrogen atoms.

Also in the preferred embodiment the stabilizer can be activated. Activated means that the resultant product of the heterocyclic organic compound reacting with the decomposing ADN provides a compound that may further react, at another site on the molecule, with the decomposing ADN. More preferably the activated heterocyclic organic compound comprises an amino activating group and/or hydroxy activating group attached to the compound. Multiple activating groups on individual heterocyclic organic compounds are particularly desired to increase the neutralization of decomposition components of the ADN for a given amount of stabilizer. Amino groups provide potentially better stabilization, since they possess the structure to provide for one additional absorption of decomposition product over hydroxy groups. As seen in reaction (II) below, heterocyclic compounds containing amino sites react with the decomposition products of the ADN and provide a resultant compound that possesses sites that may further react with the decomposing ADN. Preferably, the heterocyclic organic compounds are polyamino derivatives.

Polyamino stabilizer reactions may be exemplified by the following aminopyridine reactions (IIA–IIC):

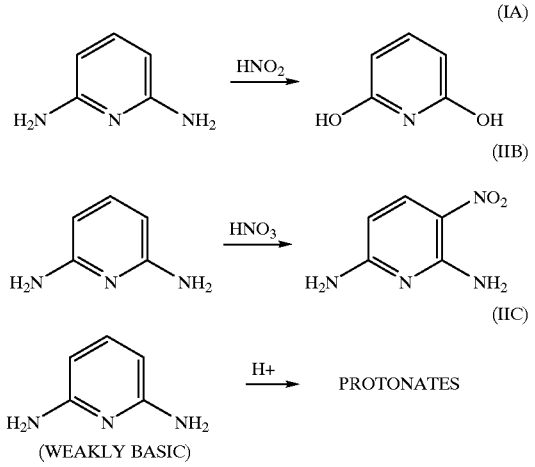

As seen in reactions IIA and IIB, the stabilizer reacts and neutralizes nitric and nitrous acid from the decomposing ADN. Reaction IIC illustrates neutralization of protons from acidic decomposition products. Charge-transfer complexes are also formed from these reactants.

Additional examples of the present invention include the following pyrimidine reactions (III–VI):

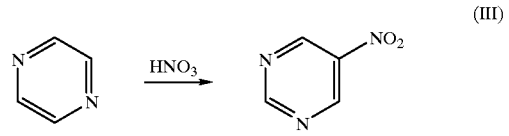

-continued (IV)

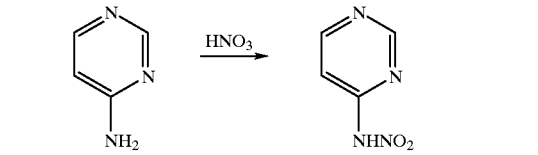

(V)

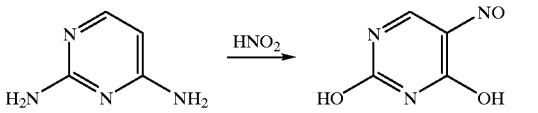

(VI)

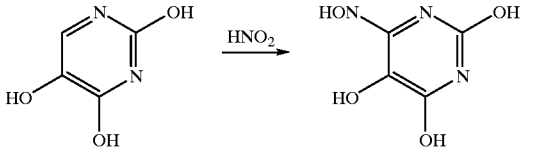

The stabilizer of the present invention provides several advantages to the ADN composition. Since the activation of sites on the molecule by reaction with ADN decomposition products results in a further enhancement in the scavenging of ADN decomposition products, a relatively small amount of stabilizer is required. Since the amount of organic material incorporated as a stabilizer into the ADN is smaller, the hazards associated with intimate mixtures of organic materials with oxidizers, such as sensitivity to unwanted initiation are proportionally less. The smaller proportions of stabilizer material in the ADN allow for greater release of energy in formulations containing ADN.

Heterocyclic organic compounds of the present invention may include such compounds as substituted and unsubstituted pyridines, pyrimidines, pyrazines, triazines, quinolines, quinoxalines, cinnolines, pteridines, acridines, phthalazines, and analogous multi-ring analogues, salt complexes, and/or derivatives thereof The heterocyclic aromatic, nitrogen-containing organic compounds are preferably substituted with an amino or hydroxy substituent. Heterocyclic organic compounds having an amino activating group may include, but are not limited to, aminopyridines, aminopyrimidines, aminopyrazines, aminotriazines, aminoquinolines, aminoquinoxalines, aminocinnolines, aminopteridines, aminoacridines, aminophthalazines, and analogous amine substituted multi-ring heterocyclic organic compounds. Heterocyclic organic compounds substituted with a hydroxy activating group may include the hydroxy form of the above described compounds. The present invention may non-exclusively include ADN stabilizers including pyridines such as dipyridylamine, pyrimidines such as 2,4,6-triaminopyrimidine, 4,5,6-triaminopyrimidine, 4,6-diaminopyrimidine, 2-aminopyrimidine, 2,4,5,7-tetraminopyrimidine, barbituric acid, and other like compounds, pyrazines such as aminopyrazine, triazines such as s-triazine, quinolines such as 3-aminoquinoline, quinoxalines such as 2-quinozalinol, cinnolines such as cinnoline hydrochloride hydrate, pteridines such as pterin, acridines such as 9-aminoacridine, and phthalazines such as 1(2H)-phthalazinone. Most preferably, the stabilizers of the present invention include 2,4,6-triaminopyrimidine; 2,2'-dipyridylamine and riboflavin. The heterocyclic organic compounds of the present invention do not possess a third-dimensional non-planar bridging ring structure such as that found in hexamine. The planar structures of the present invention possess a capability to form charge transfer complexes with acids that can not be formed from hexamine and hexamine-like structures.

Representative compound structures for the heterocyclic compound stabilizers of the present invention may include:

Pyridine (VII), Pyrimidine (VIII), Pyrazine (IX) and S-Triazine (X) structures such as:

VII

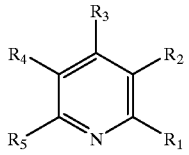

VIII

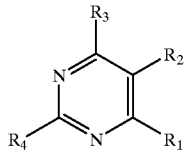

IX

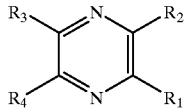

X

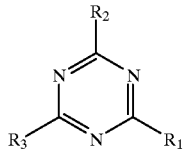

Quinoline (XI), Quiniazoline (XII) and Quinoxaline (XIII) structures such as:

XI

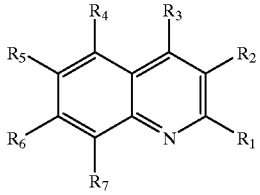

XII

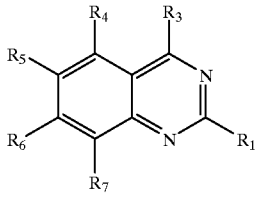

XIII

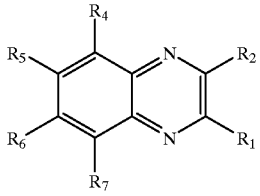

Pyrimidopyridine (XIV), Pteridine (XV), Pyrimidopyridazine (XVI), and Purine (XVII) structures such as:

XIV

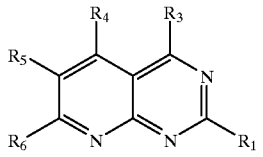

XV

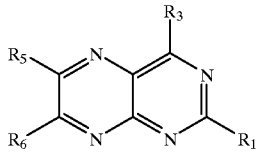

XVI

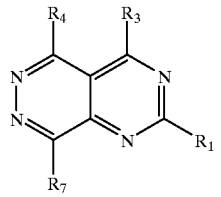

XVII

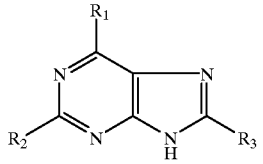

Acridine (XVIII) and Phenazine XIX) structures such as:

XVII

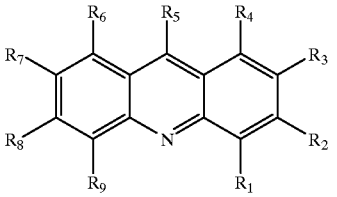

XIX

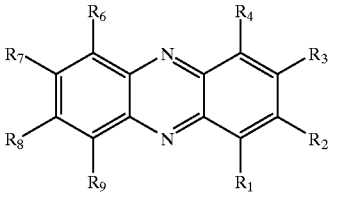

wherein $R_1$, $R_2$, $R_3$, $R_4$, $R_5$, $R_6$, $R_7$, $R_8$, or $R_9$ is independently an activating group, preferably—OH or —$NH_2$, or may be missing or replaced with a non-activating group substituent provided that the non-activating group substituent does not significantly interfere with ADN stabilizing reactions of the compound; preferably at least one of $R_1$, $R_2$, $R_3$, $R_4$, $R_5$, $R_6$, $R_7$, $R_8$, or $R_9$ is present as an activating group, more preferably two or more of $R_1$, $R_2$, $R_3$, $R_4$, $R_5$, $R_6$, $R_7$, $R_8$, or $R_9$ are present as an activating group, and most preferably two or more of $R_1$, $R_2$, $R_3$, $R_4$, $R_5$, $R_6$, $R_7$, $R_8$, or $R_9$ are present as amino groups. Substituent groups that may interfere with the ADN stabilizing reactions of the stabilizer include strong reducing groups, such as allylic groups, or groups that sterically interfere with activation or activated sites on the molecules or incorporate large amounts of added organic material into the stabilizer.

Preferably, the stabilizer is incorporated with the ADN in an amount of from about 0.001 weight percent to about 5 weight percent, more preferably from about 0.01 weight percent to about 2 weight percent, and most preferably from about 0.1 weight percent to about 1 weight percent of the amount of the ADN. When used as an oxidizer, the ADN may comprise from about 5 weight percent to about 60 weight percent of a reacting energetic material, more preferably from about 10 weight percent to about 50 weight percent, and most preferably from about 20 weight percent to about 40 weight percent. The stabilized ADN composition may comprise additional ingredients that facilitate the use of the stabilized ADN as an oxidizer, or for a given purpose. These ingredients may include component parts of propellants, pyrotechnics, explosives, gas generator formulations, and other such additives.

EXAMPLES

ADN Decomposition

Previous decomposition studies of ADN in the liquid state (104° C. to 170° C.) indicated two competing mechanisms, one forming $NO_2$, the other generating nitric acid. The rate of the decomposition reaction was found to increase with temperature and with increasing concentration of the decomposition products. Decomposition also occurs in the solid phase (40° C. to 80° C.), resulting in ammonium nitrate and gaseous products, which are generated at lower rates.

Our studies involved pulverizing 500 mg of ADN with 1% of the compound additive in a dental amalgamator and pressing the mixtures in a die. The resulting pellets were aged at 100° C. in crucibles and the weight loss noted over time. Some of these pellets of ADN and stabilizer additive were repulverized and mixed into a model binder consisting of hydroxy-terminated polybutadiene rubber crosslinked with hexamethylene diisocyanate (HTPB-HMDI). The weight-loss method was able to identify the superior and inferior stabilizer candidates in a satisfactory manner.

Control samples for all aging runs included neat ADN having no stabilizer, ADN stabilized with hexamine, HTPB-HMDI binder with inert filler material, and neat ADN with hexamine and binder. The additives showed stabilization potential if their weight loss curves stayed above that of straight ADN during the first 5–15% of weight loss, even if weight loss at a later point of the curve was greater, and accelerated faster, than that of neat ADN. This conclusion was dictated by the behavior of the hexamine-containing control sample, which showed retarded weight loss early on, appeared to accelerate the ADN decomposition in the later stages of the experiment, and then decomposed at approximately the same rate as neat ADN in the extreme stages. This behavior is indicative of a system in which the additive performs its stabilizing function until saturated with acid, and/or is oxidized, whereupon the partially-oxidized product is more vigorously attacked by the remaining ADN, its decomposition intermediates, and AN. The prevention of weight loss at the beginning of the aging cycle is the most important criterion for a truly effective stabilizer, since by the time the oxidizer has lost 3–5% of its weight, the properties of the formulation in which it is incorporated would exhibit a noticeable degradation of ballistic properties. However, the long-term weight-loss prevention facilitated by some of the additives indicates an importance in the storage of neat ADN, and its potential for prilling, repurification and recycling.

Model Binder System Compound

Figure 5:
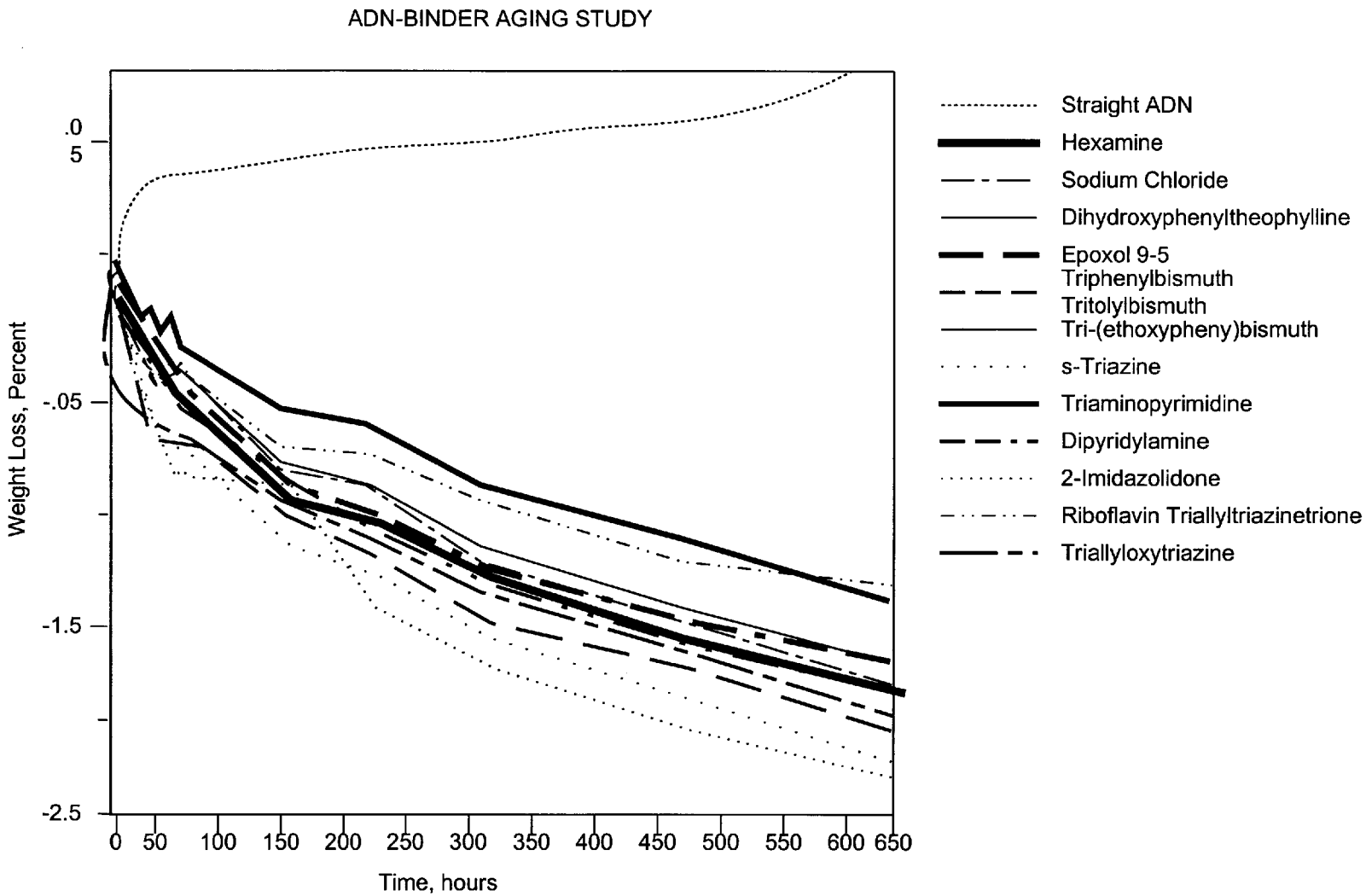

Eighteen of the twenty-seven compounds tested were further tested as ADN stabilizers when used in a R-45M hydroxy-terminated polybutadiene crosslinked with hexamethylene diisocyanate model binder system. These compounds, with the resulting data, are shown in FIG. 5. The pellets that were formed were repulverized and then hand-mixed with 10% by weight binder-crosslinker. Aging was performed at 160° F. No cure catalyst was added, in order to avoid the possibility of the catalyst affecting the ADN aging.

FIG. 1 is a plot of ADN with some stabilizing compounds, showing weight losses over time. Compounds which were shown to apparently stabilize neat ADN include hexamine; 7-(2,3-)dihydroxypropyltheophylline; 2,4,6-triaminopyrimidine; 2,2,'-dipyridylamine; riboflavin; and N-methyl-4-nitroaniline (MNA). Particularly effective compounds were 2,4,6-triaminopyrimidine and MNA, which retard weight loss better and for longer time periods than hexamine. MNA has a long history of use as a stabilizer in propellant formulations that does not fall within the scope of the present invention, and is used in FIG. 1 as a control stabilizer. 2,2'-dipyridylamine approaches hexamine in performance, as does riboflavin.

The majority of efficacious stabilizers shown in FIG. 1 incorporated pyridine or pyrimidine rings, with pendant amine or cyclic amine structures.

Figure 2:
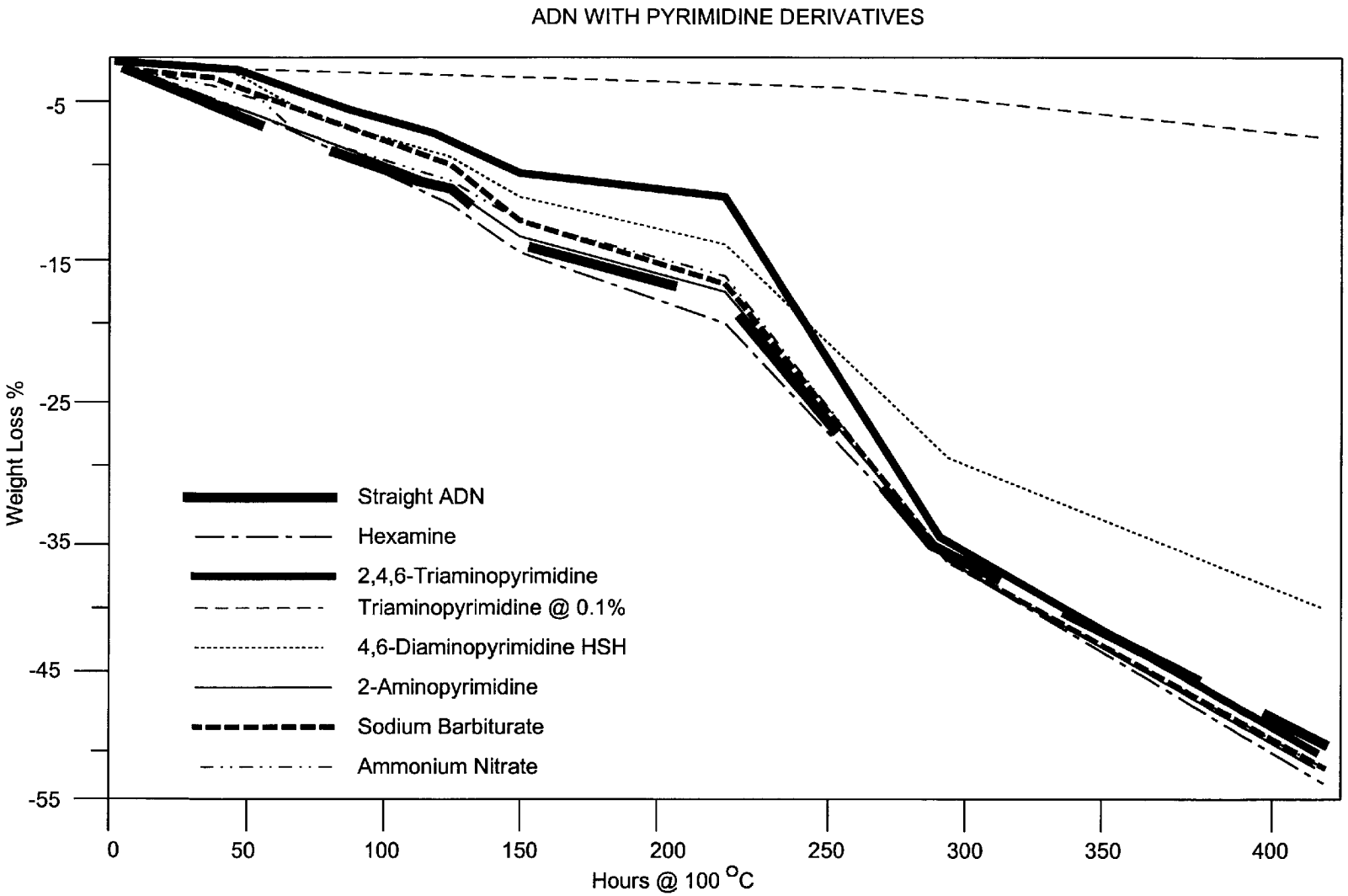
FIG. 2 is a plot of ADN with pyrimidine derivatives.

FIG. 2 is a plot of 100° C. aging of ADN with a group of analogous pyrimidine structures to that of FIG. 1. The compounds in FIG. 2 appeared to stabilize as well as hexamine for the first 9 hours, including a sample incorporating 2,4,6-triaminopyrimidine at one-tenth the concentration of the other candidates. 2-Aminopyrimidine lost its efficacy, compared to hexamine, at 17 hours, but it did continue to impart a measure of stabilization, compared to neat ADN, for 40 hours. Sodium barbiturate was a better stabilizer than either 2-aminopyrimidine or hexamine, and 4,6-diaminopyrimidine hemisulfate hydrate showed some promise in the early stages of aging. This last compound also retarded weight loss at extreme aging times better than 2,4,6-triaminopyrimidine, suggesting that the inorganic salt is protected somewhat from oxidation (and thus less effective at first) until conversion to the dinitramide takes place. If such a mechanism is occurring, this suggests an importance to an admixture of aminopyrimidines and their inorganic salts resulting in a "timed-release" long-term ADN stabilizer. The most efficacious material overall for the first 225 hours remained 2,4,6-triaminopyrimidine. Ammonium nitrate was included in this aging study to provide a comparison of its thermal decomposition with that of ADN. From these studies, it does not appear that ADN converts completely to AN and gaseous products until extreme exposure times are reached.

Figure 3:
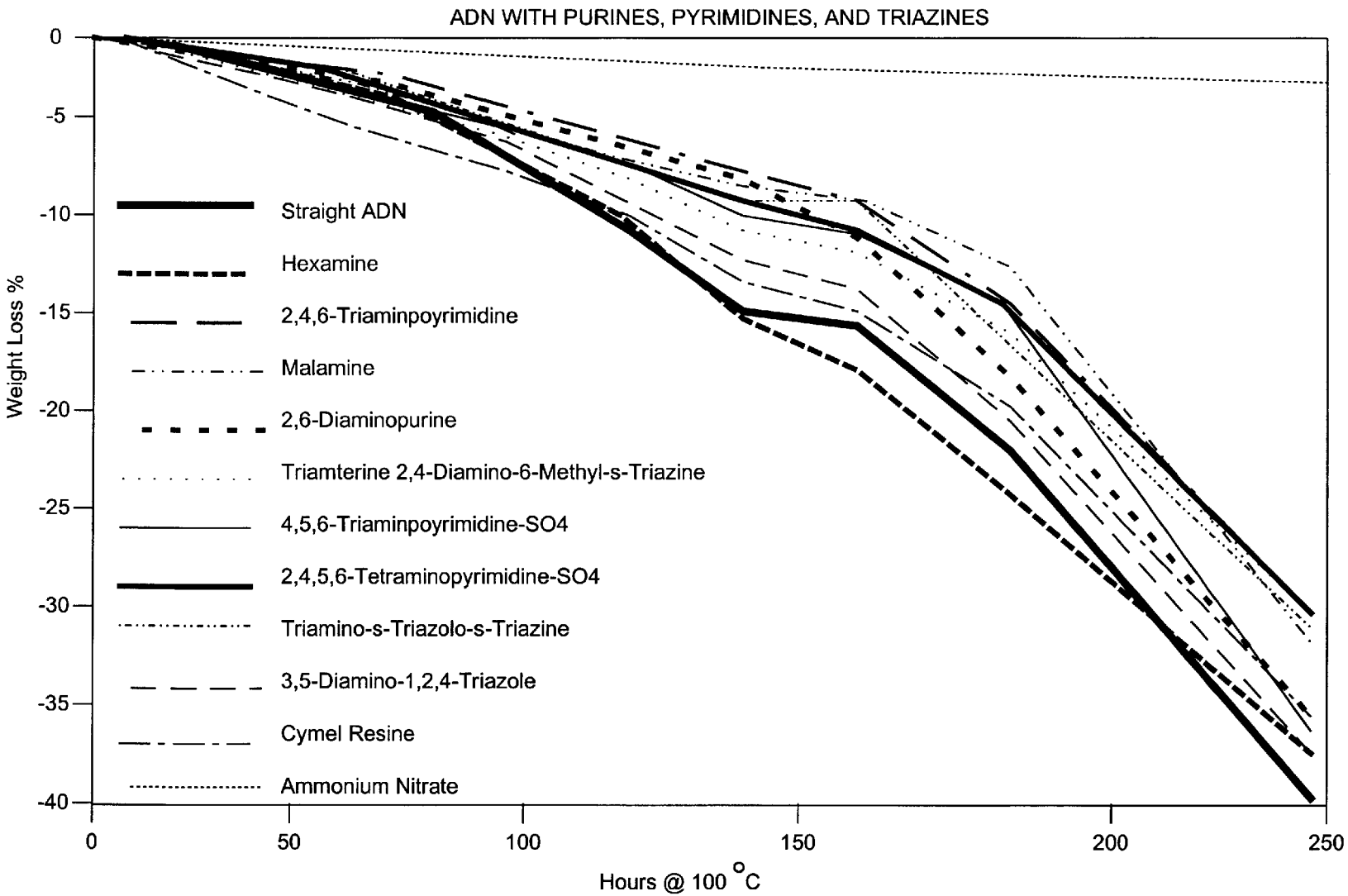
FIG. 3 is a plot of ADN with purines, pyrimidines and triazines.

FIG. 3 is a plot of ADN with purines, pyrimidines and triazines. Most of the compounds tested retarded weight loss better than hexamine after 100 hours aging, but the only better performers than hexamine in the most critical earlier stages of exposure were 2,4,6-triaminopyrimidine, 4,5,6-triaminopyrimidine sulfate, 2,4,5,6-tetraminopryrimidine sulfate, with triamterene(2,4,7triamino-6-phenylpteridi showing some promise as a possible contender. The sulfate salts of the aminopyrimidines were, again, not as effective as the triaminopyrimidine in the early stages, but decreased ADN weight loss on long-term aging better than the free amine.

Figure 4:
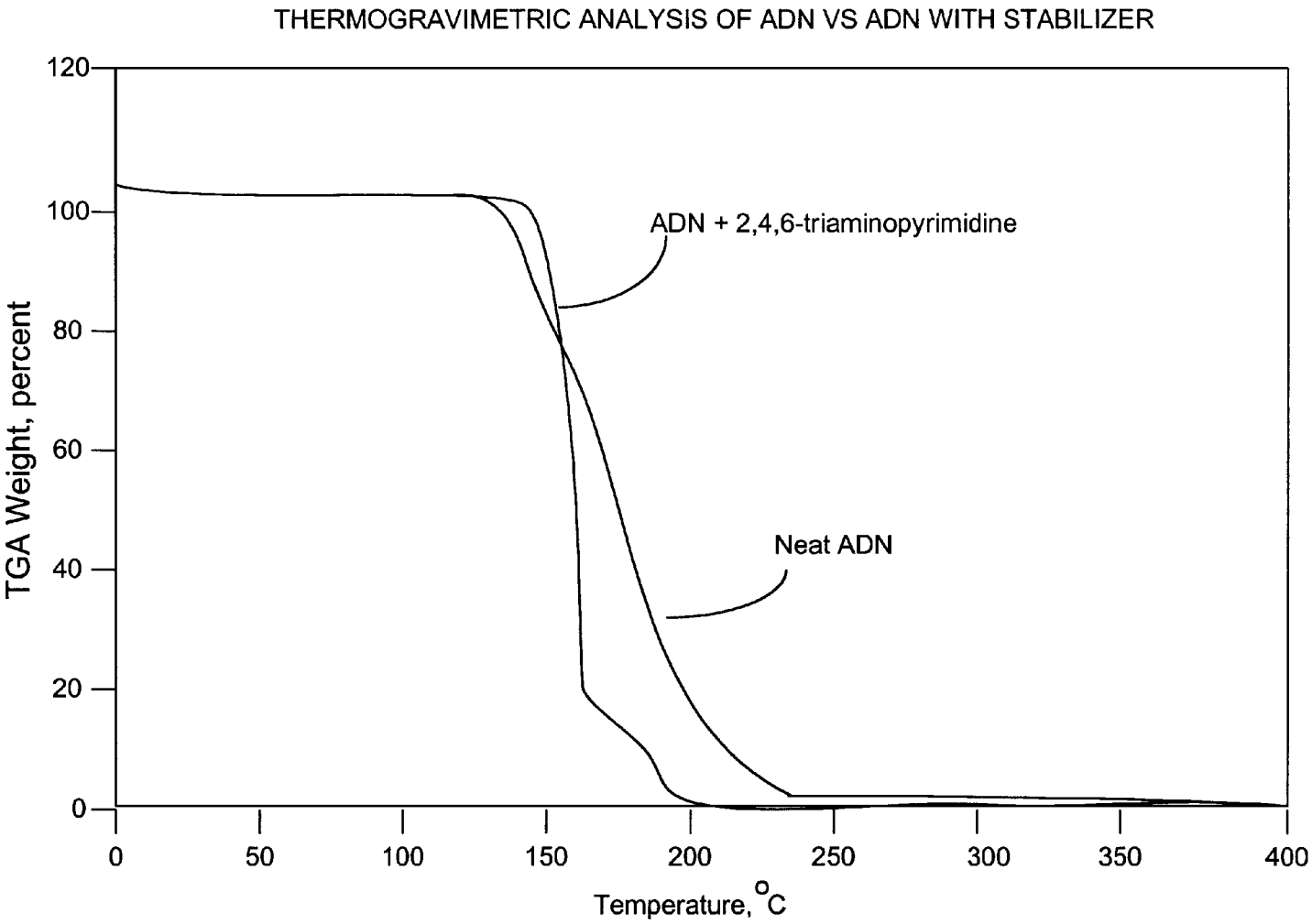
FIG. 4 is a plot of Thermogravimetric Analysis (TGA) of ADN compared with ADN with stabilizer; and, FIG. 5 is a plot of an ADN-Binder Thermal Aging Study.

FIG. 4 is a plot of thermogravimetric Analysis (TGA) of neat ADN compared with ADN with stabilizer, with the TGA done with a stabilizer of 1% 2,4,6-triaminopyrimidine. FIG. 4 shows that the onset temperature to decomposition for the stabilized material is raised by approximately 12° C. at the instrument's ramping rate of 10° C./min.

FIG. 5 is a plot of an ADN-Binder Aging Study. The interpretation of results for the aging study with the model binder system is, in theory, less straightforward than that of the ADN samples themselves. The binder-crosslinker mixture, mixed with sodium chloride as a control, itself gained weight over the course of the study, probably from atmospheric oxidation. Some of the additives in the ADN could thus be merely facilitating or otherwise participating in the reaction of the gaseous products of ADN decomposition with the binder. This would result in no net sample weight loss, even though no particular ADN stability had been gained. This is a limitation of the weight loss technique used in these experiments. Nonetheless, the compounds which performed well with ADN itself in most cases also showed superior weight-loss retardation in the binder studies.

The ADN-binder studies showed MNA as the best retarder of weight loss, with 2,4,6-triaminopyrimidine providing a similar result. 7-(2,3-dihydroxypropyl)theophylline and 2,2dipyridylamine also retarded weight loss. Although the binder oxidation reactions complicate the results obtained by the weight-loss method utilized, it is noteworthy that several of the additives that appeared to best stabilize solid ADN were also successful in retarding weight loss in the course of this study.

Compounds which incorporate amino- or hydroxypyrimidine or aminopyridine functions appear to have potential for stabilization above all other candidates tested. This property does not appear to be a simple function of having the maximum number of nitrogen proton acceptor sites possible in a given molecule (as the mediocre stabilization afforded ADN by melamine and the other amine-substituted triazines demonstrated), but must be a function of characteristic chemical reactions afforded by the optimum stabilizer compounds.

All ADN stabilizer candidates which work to any extent are weak-to-moderately strong bases, capable of reaction with acid moieties. Moderately basic compounds are identified since decomposition of ADN takes place at both extremes of pH. ADN-stabilizing additives are also capable of reactions with oxidized nitrogen species. The ability of a relatively small molecule to scavenge large quantities of such decomposition products by a multiplicity of potential reactions is the key to efficacious stabilization. Any increase in reactivity, or number of reactive sites, on a stabilizer candidate which results in a larger uptake of acids and oxidized nitrogen species, will increase the efficacy of the compound as an ADN stabilizer.

The 5-position of pyrimidine is prone to electrophilic attack, especially when the 2,4, and 6 positions have activating groups, such as hydroxyl and amino groups, on them. This position in such species as the aminopyrimidines and barbituric acid structures could react with nitronium ion generated from nitric acid, one of the ADN decomposition products. An amino-group on the 5-position can be diazotized, absorbing nitrous acid, and the amino groups on the ring can react with nitric acid, forming nitroamino compounds. The 2-, 4-, and 6-position amino groups also react with nitrous acid, resulting in replacement with hydroxy-groups. This hydroxyl replacement can be brought about by strong acid as well. These hydroxyls would maintain the activity of the 5-position of the pyrimidine for scavenging other oxidized nitrogen species. A nitro-group on the 5-position would facilitate nucleophilic attack on other ring positions. This extensive repertoire of neutralization, nitration, nitrosation and amine replacement reactions that aminopyrimidines can undergo with the decomposition products of ADN is mirrored by the persistence with which they stabilize ADN, both over the short and the long term. Such compounds as barbituric acid, with less versatile reactive sites, and the theophylline and the pteridine derivatives, which average fewer reactive sites on larger molecular structures, are thus less efficacious and shorter-acting performers on a weight-for-weight comparison.

The development of blue or violet colors upon nitrosation of pyrimidines has been noted in the literature, and the molten ADN treated with 2,4,6-triaminopyrimidine, 4,6-diaminopyrimidine hemisulfate hydrate, and sodium barbiturate all exhibited color reactions ranging from pink to violet. The disappearance of the color in the sample after a period of thermal aging generally heralded the beginning of the accelerated decrease in the weight of the sample. This property could be used to provide a visual check or indicator on the stabilizer content in ADN in storage.

Although pyridine itself is difficult to nitrate, amino groups facilitate the reaction, which then occurs at low temperatures. Primary amine substituents form an intermediate nitramino-derivative, which rearranges to a ring-nitro group ortho- orpara- to the amine. Tertiary amines nitrate directly on the ring. Acidic conditions can also replace the amino- group with hydroxyl, and the same replacement occurs with nitrous acid. Thus, aminopyridines would also exhibit a variety of reaction modes for scavenging ADN decomposition products. It can be seen by the examples that substituted compounds having large amounts of added material apparently interfere with the proper mechanism of the present invention.

The foregoing summary, description, drawings and example of the present invention are not intended to be limiting, but are only exemplary of the inventive features which are defined in the claims.

What is claimed is:

1. An ammonium dinitramide composition comprising:

ammonium dinitramide; and, an amount of an aromatic-containing heterocyclic organic compound effective to stabilize the ammonium dinitramide;

the heterocyclic organic compound comprising a six ring member.

2. An ammonium dinitramide composition comprising:

ammonium dinitramide; and, an amount of an aromatic-containing heterocyclic organic compound effective to stabilize the ammonium dinitramide;

the heterocyclic organic compound comprising a stabilizing compound selected from the group consisting of 7-(2,3-)dihydroxypropyltheophylline, 2,4,6-triaminopyrimidine, 2,2'-dipyridylamine; and riboflavin.

3. An ammonium dinitramide composition comprising:

ammonium dinitramide; and, an amount of an aromatic-containing heterocyclic organic compound effective to stabilize the ammonium dinitramide;

the stabilizer being present in an amount of from about 0.1 weight percent to about 1 weight percent to the ammonium dinitramide.

4. An ammonium dinitramide composition comprising:

ammonium dinitramide; and, an amount of an aromatic-containing heterocyclic organic compound effective to stabilize the ammonium dinitramide;

the stabilizer comprising from about 1 to about 3 nitrogen atoms within the structure of the heterocyclic organic compound; and, the heterocyclic organic compound comprising activated pyrimidines.

5. The ammonium dinitramide composition of claim 4 wherein the pyrimidines comprise 2,4,6-triaminopyrimidine.

6. The ammonium dinitramide composition of claim 4 further comprising an indicator wherein the disappearance of blue-violet colors evidences loss of the stabilizer and signals accelerated degradation of the ammonium dinitramide.

* * * * *